US006553999B1

(12) United States Patent
Cardone et al.

(10) Patent No.: US 6,553,999 B1
(45) Date of Patent: Apr. 29, 2003

(54) MANUFACTURE OF CIGARETTE ASSEMBLIES HAVING A PRE-FORMED TUBULAR BAND AND A PRE-FORMED TOBACCO ROD

(75) Inventors: Michael Cardone, Brossard (CA); Luc Gaetan Duplessis, Montreal (CA); Marcel Champagne, Dollard-des-Ormeaux (CA)

(73) Assignee: Imperial Tobacco Canada Limited (CA)

( * ) Notice: Subject to any disclaimer, the term of this patent is extended or adjusted under 35 U.S.C. 154(b) by 0 days.

(21) Appl. No.: 09/744,899

(22) PCT Filed: Jul. 30, 1999

(86) PCT No.: PCT/CA99/00697

§ 371 (c)(1),
(2), (4) Date: Jan. 31, 2001

(87) PCT Pub. No.: WO00/07467

PCT Pub. Date: Feb. 17, 2000

(30) Foreign Application Priority Data

Jul. 31, 1998 (CA) ..... 2244453

(51) Int. Cl.[7] ..... A24C 5/00
(52) U.S. Cl. ..... 131/58; 131/64.2; 131/105
(58) Field of Search ..... 131/350, 358, 131/360, 365, 361, 331, 335, 336, 58, 60, 61.1, 64.2, 70, 71, 72, 73, 74, 76, 105; 493/39, 42, 45, 46, 47, 48

(56) References Cited

U.S. PATENT DOCUMENTS

| | | | | | |
|---|---|---|---|---|---|
| 2,882,970 | A | * | 4/1959 | Schur | 131/88 |
| 3,306,306 | A | * | 2/1967 | Rudszinat | 131/94 |
| 3,359,988 | A | * | 12/1967 | Thomson | 131/336 |
| 4,282,889 | A | * | 8/1981 | Dahlgrun | 131/281 |
| 4,541,825 | A | * | 9/1985 | Hyde et al. | 19/65 T |

FOREIGN PATENT DOCUMENTS

| | | | | |
|---|---|---|---|---|
| DE | 2609809 | * | 12/1976 | A24C/5/46 |
| DE | 3510304 | * | 9/1986 | A24C/5/46 |
| DE | 3629083 | * | 3/1988 | A24C/5/46 |
| DE | 41 07026 | * | 3/1992 | A24C/5/40 |
| DE | 4035422 | * | 5/1992 | A24C/5/46 |
| DE | 93 19938.4 | * | 3/1994 | A24C/5/40 |
| DE | 19604427 | * | 8/1997 | A24C/5/40 |
| EP | 0632967 | * | 1/1995 | A24C/5/40 |
| EP | 0689776 | * | 1/1996 | A24C/5/00 |
| WO | 98 07338 | * | 2/1998 | A24C/5/40 |

* cited by examiner

*Primary Examiner*—Peter Chin
*Assistant Examiner*—Carlos Lopez
(74) *Attorney, Agent, or Firm*—Wolf, Greenfield & Sacks, P.C.

(57) ABSTRACT

Self-made cigarettes, i.e. tobacco products that are supplied in unsmokable condition in the form of a tobacco-bearing component (12) comprising a tobacco rod (14) attached to a porous filter (16) at least part of the surface of which is highly permeable, and an impervious tubular band (10) carried on the component and slidable along it to cover the permeable region. The tubular band can be applied by compressing the tobacco-bearing component to enable the preformed tubular band to be slid onto it. Tubular bands (10) are automatically assembled onto tobacco bearing components by an apparatus that includes a rotary drum (30) around the periphery of which are distributed sets of assembly tools (62) each of which sets comprises a pair of opposed rods (90, 106) which are employed to Introduce the tubular band and the tobacco bearing component into opposite ends of an assembly cylinder (44) wherein the band is slid onto the tobacco component, the assembled product subsequently being ejected. The components are fed into the successive assembly tool sets as the latter are rotated on the drum past a feed point, actuation of the rods being effected by means of stationary cams (100, 118) past which the rods are moved by rotation of the drum.

14 Claims, 5 Drawing Sheets

MANUFACTURE OF CIGARETTE ASSEMBLIES HAVING A PRE-FORMED TUBULAR BAND AND A PRE-FORMED TOBACCO ROD

RELATED APPLICATIONS

This application claims the benefit under 35 U.S.C. §120 or 35 U.S.C. §365(c) of PCT International application PCT/CA99/00697 designating the United States of America, and filed Jul. 30, 1999, of which this application is a national stage filing under 35 U.S.C. §371, was published under PCT Article 21(2) in English.

Foreign priority benefits are claimed under 35 U.S.C. §119(a)–(d) or 35 U.S.C. §365(b) of Canadian application number 2,244,453 filed Jul. 31, 1998, which designated at least one country other than the United States.

This invention relates to a new or improved method and apparatus for manufacturing a tobacco product in an unsmokable form, but in such a way that the user can readily convert them to smokable cigarettes.

For many years a certain segment of the smoking population has, for either economic or aesthetic reasons, preferred to smoke a self-made cigarette rather than the more conventional and more popular machine-made variety of cigarette.

While originally, self-made cigarettes were assembled by the smoker shaking loose cut tobacco onto a rectangular sheet of cigarette paper and then fashioning the sheet into a tube, over the years various appliances and systems have been developed to enable the smoker to produce a more regular style of self-made cigarette. Some aids that have in the past been devised for facilitating the self-made cigarette fabricating process have enjoyed commercial success. However in terms of product quality even the best of them has scarcely been able to produce an adequate substitute for a machine-made cigarette. There is however an ongoing demand for supplies for self-made cigarettes which at least in part is due to the more favourable tax treatment (as compared to conventional machine-made cigarettes) which these enjoy in some jurisdictions.

Our Canadian Patent 2,184,035 issued Jun. 15 1999 describes and illustrates embodiments of non-smokable tobacco products which can easily be converted by the smoker into a smokable cigarette. Amongst the most easily used embodiments described in the aforesaid patent are those which provide a tobacco-bearing component such as a rod-shaped tobacco element in combination with a filter element arranged end-to-end therein, said component having over part of its length an air-permeable surface area such as a porous filter surface rendering the component non-smokable. This component is provided in combination with a sliding tubular band carried on and closely surrounding the surface of the component. To render the product smokable, the user need merely slide the tubular band along the component to a position where it covers the air-permeable area. Such a non-smokable cigarette is considered by some to be vastly superior to all other forms of self-made cigarette supplies by virtue of its ease of use, and the close similarity of the finished product to a machine-made cigarette.

The present invention is concerned with the manufacture of self-made cigarette supplies as discussed in the preceding paragraph.

The invention provides a method of manufacturing a tobacco product in non-smokable form, comprising: providing a tobacco bearing component having a rod-shaped tobacco element, said component being non-smokable by virtue of the presence of an air-permeable area in the peripheral surface thereof extending over a minor portion in the length of said component; and enclosing said component in a tubular band of flexible sheet material of low permeability to the passage of air therethrough, said tubular band closely surrounding said component, being at a longitudinally offset position with respect to said air-permeable area, and being manually displaceable along said component to a position covering said air-permeable area to an extent sufficient to render said tobacco product into smokable condition.

The tobacco-bearing component may be in various forms, but preferably includes a filter fixed end-to-end with a tobacco rod, the latter being enclosed in a tube of regular cigarette paper, the air-permeable area being provided as a porous surface on the periphery of the filter, thus rendering the product unsmokeable.

A preferred assembly method involves applying a preformed tubular band onto the tobacco bearing component by arranging said tubular band and said tobacco-bearing component in axial alignment, and effecting relative axial movement towards one another of said tubular band and said tobacco-bearing component to bring these into engagement while effecting a slight compression of said tobacco rod to ease entry thereof into the interior of the tubular band, and sliding said tubular band to a desired location in the length of said tobacco rod. Radial compression of one end of the tobacco-bearing component to a size slightly smaller than the diameter of the tubular band enables the latter to be slid easily onto the tobacco-bearing component. Upon release of the compression force, the tobacco-bearing component is resiliently restored to its normal extent (which is of a circumference closely matched to that of the preformed tubular band) so that the latter will not accidentally shift along or fall off the tobacco-bearing component, but on the other hand can be slid therealong with minimal effort on the part of the user.

From another aspect, the invention provides an apparatus for assembling a preformed tubular band of filter cover material onto a preformed tobacco-bearing component which comprises a filter fixed end-to-end with a tobacco rod, said apparatus comprising: a first guide to receive said tubular band; a second guide to receive said tobacco rod; an assembly cylinder positioned between and in axial alignment with said first and second guides, said assembly cylinder having at a first end thereof adjacent said first guide an entry bushing which has a bore of a length and diameter corresponding to that of the filter cover, and at a second end an introducer bushing that has a bore substantially corresponding to the outer diameter of said tobacco rod, and between said entry bushing and said introducer bushing a sizing disc having a bore that tapers in the direction towards said entry bushing adjacent which it has a diameter that is smaller than the diameter of said entry bushing bore; said apparatus including a first movable member that is engageable with said tubular band to advance it along said first guide towards and into the assembly cylinder, and a second member that is engageable with said tobacco rod to advance the latter along said second guide towards and into said assembly cylinder.

Preferably a series of assembly cylinders with associated first and second guides and first and second axially movable members in the form of rods are provided distributed around the periphery of a rotatable drum. At a feed station the tubular band and the tobacco rod are supplied successively into the respective guides and are carried thereby as the drum rotates, axial movement of the rods being effected by stationary cams with which the rods are operatively connected.

In addition to the slight compression of the end of the tobacco rod that is effected by the sizing disc, it is preferred also to include at each assembly cylinder means for applying vacuum to the outer periphery of the end of the tubular band that first approaches the tobacco rod. In this way an expanding force is applied to that end of the tubular band to compensate for any slight malformations that may be present, and to ease the initial engagement with the end of the tobacco rod.

The invention will further be described, by way of example only, with reference to the accompanying drawings wherein:

FIG. 1 schematically illustrates the assembly process, showing in:

FIG. 1A the tubular band and the tobacco rod component separately, indicating how the ends thereof are manipulated;

FIG. 1B the tubular band and tobacco rod being moved axially towards one another; and FIG. 1C the assembled product;

Figure 1A:
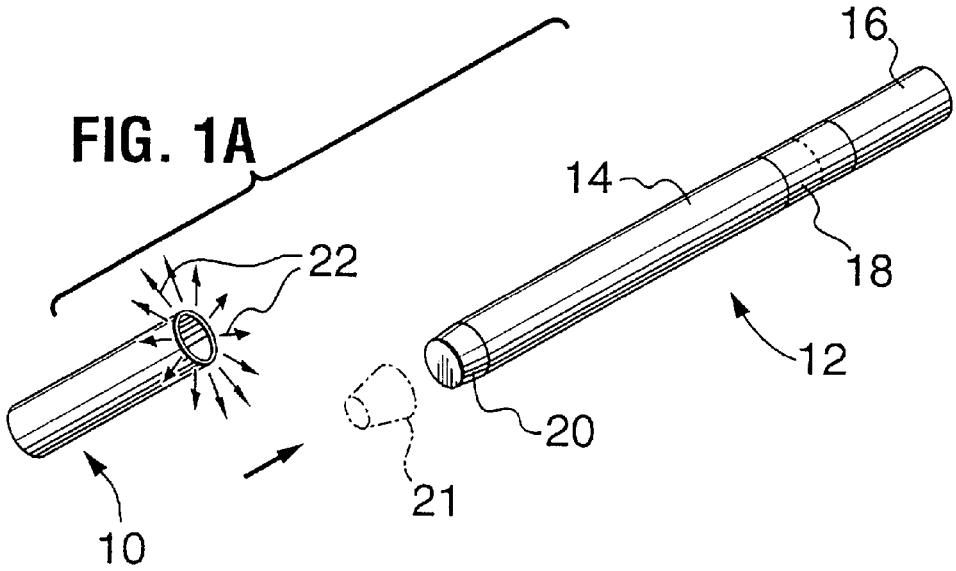

As shown in FIG. 1A, the components of the non-smokable cigarette comprise a tubular band 10 (hereinafter referred to as a filter cover) of flexible material of low or no permeability to the flow of air therethrough, and a tobacco bearing component 12, herein referred to as a "tobacco stick" as it is commonly referred in the trade. The tobacco stick 12 comprises a cylindrical tobacco rod 14 that is wrapped in regular cigarette paper and attached end-to-end with a filter 16 (as described in our above referenced Canadian Patent 2,184,035) by means of an attachment strip 18 which is wrapped around and adhered to the adjoining ends of the tobacco rod 14 and filter 16. The peripheral surface of the filter 16 is completely porous so that the tobacco stick 12 cannot be smoked since the porous outer surface of the filter will prevent a smoker from drawing air longitudinally through the tobacco rod.

Figure 1B:
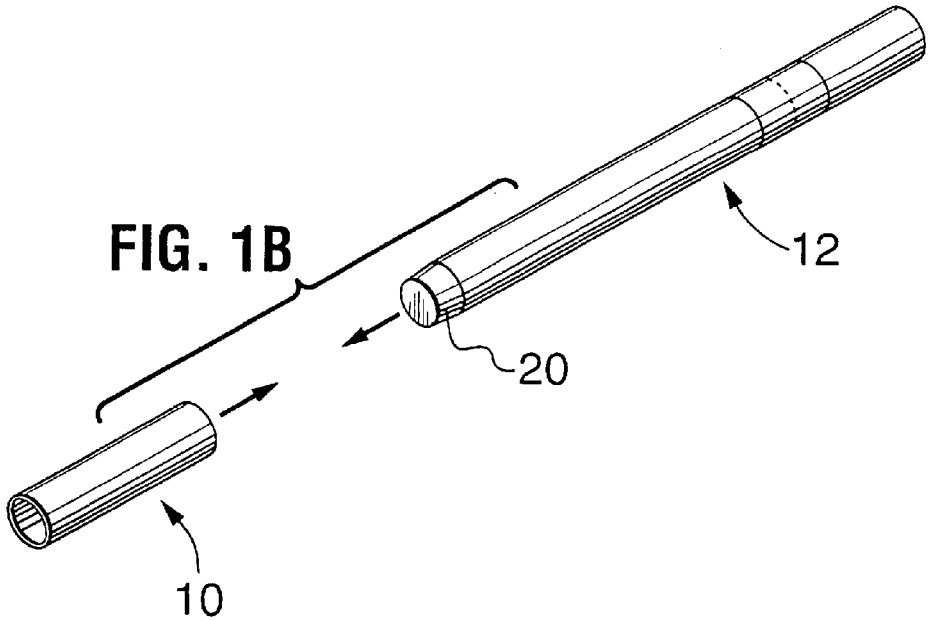

The filter cover 10 is formed from any convenient flexible substantially impervious sheet material, and may for example be of conventional filter tipping material. The filter cover 10 has an internal diameter that is matched to the outer diameter of the tobacco rod 14. In the assembly process the cover 10 and the tobacco stick 12 are moved axially towards each other as indicated by the arrows in FIG. 1B, the cover 10 being introduced over the end of the tobacco rod 14 and slid to a position shown in FIG. 1C. Since both the filter cover 10 and the wrapper of the tobacco rod 14 are of relatively delicate material, care must be taken to ensure smooth introduction of the forward end of the tobacco rod 14 into the adjacent end of the tubular cover 10. This is effected by temporarily reducing the size of the forward end of the tobacco rod 14 as indicated at 20 in FIG. 1A, by a tapered element 21 and/or expanding the confronting end of the tubular cover 10 as indicated by the radial arrows 22 in FIG. 1A.

Figure 1C:
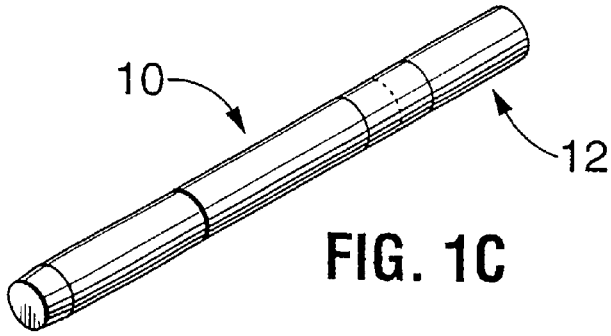

The internal diameter of the cover 10 and the external diameter of the tobacco rod 14 as mentioned are closely matched so that the cover when assembled as shown in FIG. 1C will not accidentally move along or fall out of engagement with the tobacco rod 14, but nonetheless may be readily moved manually therealong. The attachment strip 18 since it is wrapped around the tobacco rod 14 and the filter 16 naturally has an outer diameter that is slightly in excess of the diameters of those components, and in fact is slightly greater than the internal diameter of the tubular cover 10. Therefore to move the cover 10 from its inactive position shown in FIG. 1C rightwards to an active position wherein it overlies the filter 16, it is necessary to effect a slight compression of the tobacco stick in the region of the attachment strip 18. This is readily accomplished manually, and once the filter cover 10 has been moved partially over the attachment strip 18 it can readily be advanced (albeit with a slight resistance due to its interference with the external surface of the attachment strip) to a position wherein it completely covers the peripheral surface of the filter 16. In this position the filter cover 16 remains in engagement with at least part of the attachment strip 18, and it will be understood that this engagement provides a good seal against leakage of air between these components when the article is to be smoked.

The various components described may be of any suitable dimensions commonly used in cigarette manufacture. For example the tobacco stick 12 may have an overall length of 74 mm (84 mm for a king sized version) the attachment strip having a width of 10 mm and the uncovered length of the filter surface 16 having a width of 14 mm. The filter cover 10 has a width of 24 mm, i.e. is sized to completely cover the filter 16 and attachment strip 18. Typically the filter cover 10 is of a material having a thickness of 0.1 mm, and the tobacco rod 12 has a nominal external diameter of 8 mm which matches the nominal internal diameter of the cover 10.

Figure 2:
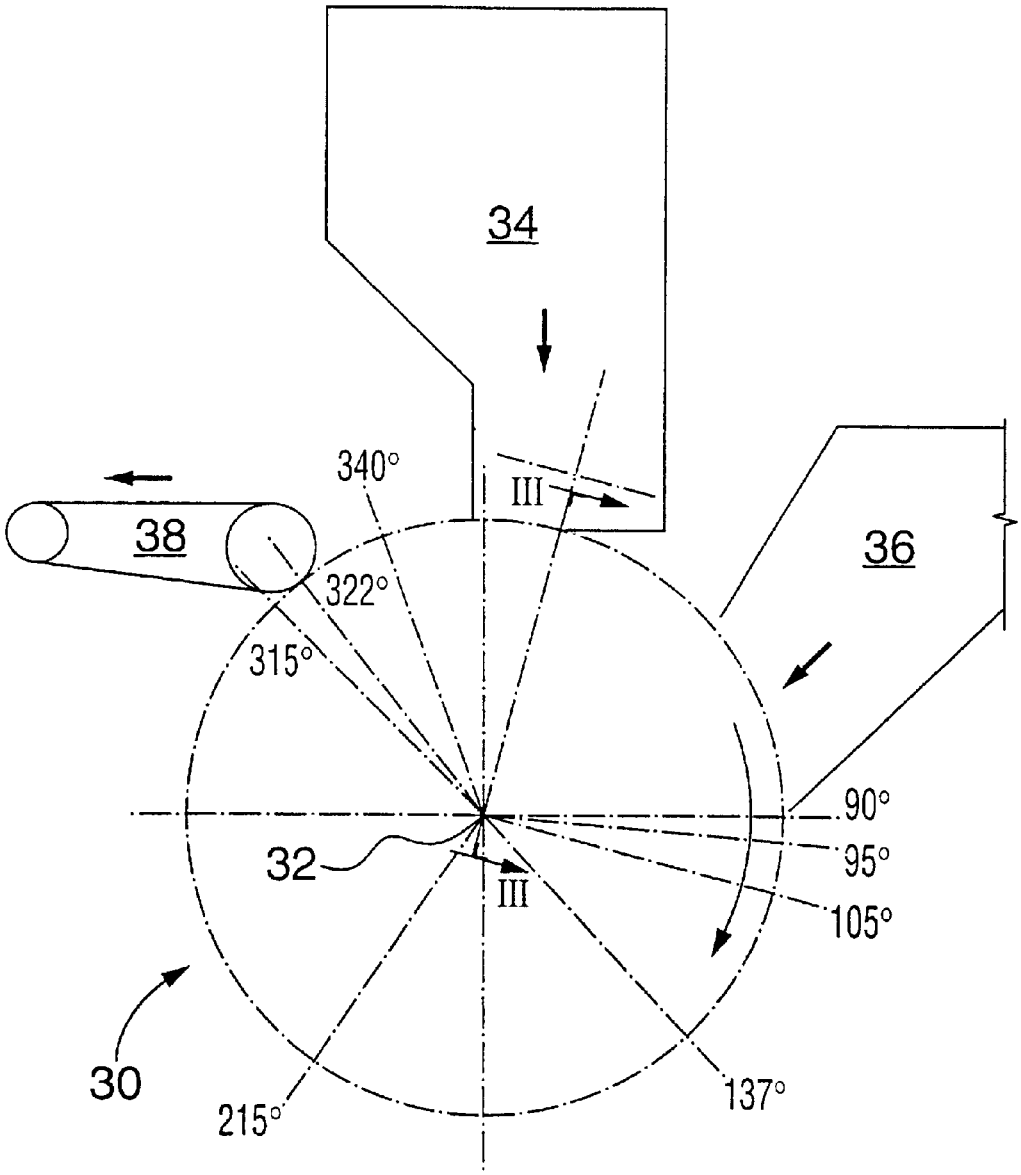
FIG. 2 is a somewhat schematic view of the assembly apparatus.

Apparatus for performing the assembly process described above in relation to FIG. 1 is shown in FIG. 2 as comprising a drum 30 that is rotatable in the direction of the arrow about a horizontal axis 32, passing in the circumferential direction a feeding station 34 for filter cover 10, a feeding station 36 for tobacco sticks 12, and a discharge station 38 for removal of the finished product from the drum. The assembly process is performed as the drum rotates from the stick feeding station 36 to the discharge station 38, as will now be described in relation to FIGS. 3 to 6.

Arranged coaxially with respect to the axis 32 is a hollow tubular shaft 40 which carries a pair of axially spaced roller bearing assemblies 42 which provides support for the drum 30.

The drum comprises three annular rings, specifically a central ring 44 flanked on opposite sides by a filter cover feed ring 46 and a tobacco stick feed ring 48, the rings being accurately machined to fit together as shown and being clamped by a series of angularly spaced axially extending threaded tie rods 50 which pass through aligned bores in the three rings, and also through axially and angularly aligned outer clamping rings 52, 54, the assembly of the rings 52, 44, 46, 48 and 54 being securely held together by nuts 56 which engage the ends of the threaded tie rods 50.

At the outboard ends of the drum 30 are a pair of disc-shaped mounting rings 58, 60 each of which is clamped at its inner periphery to a respective one of the bearing assemblies 42.

Figure 4:
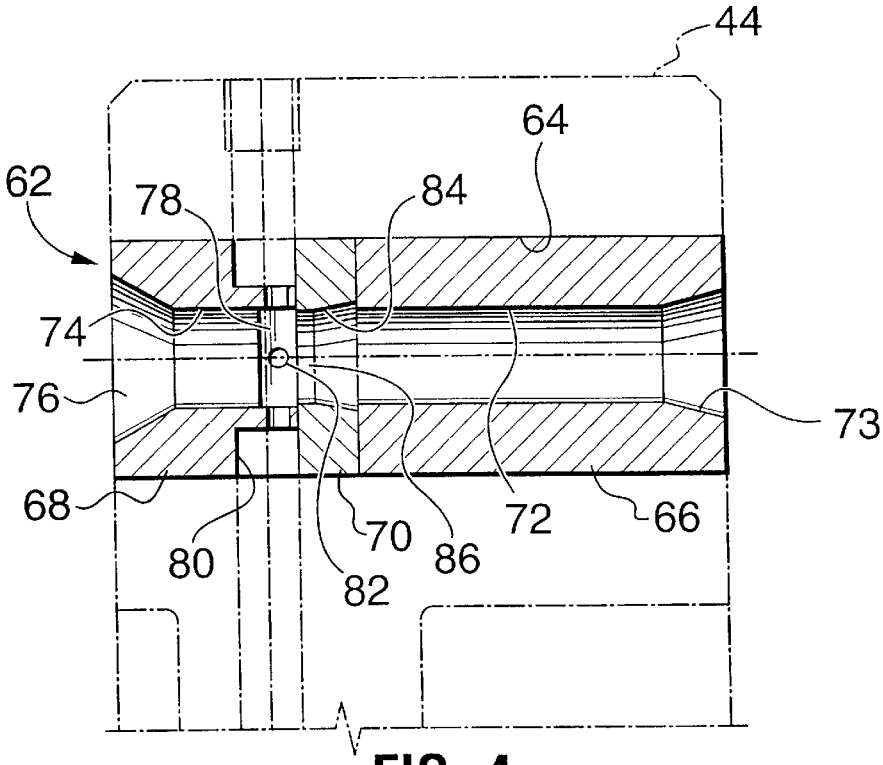
FIG. 4 is an enlarged view of a portion of FIG. 3.
Figure 5:
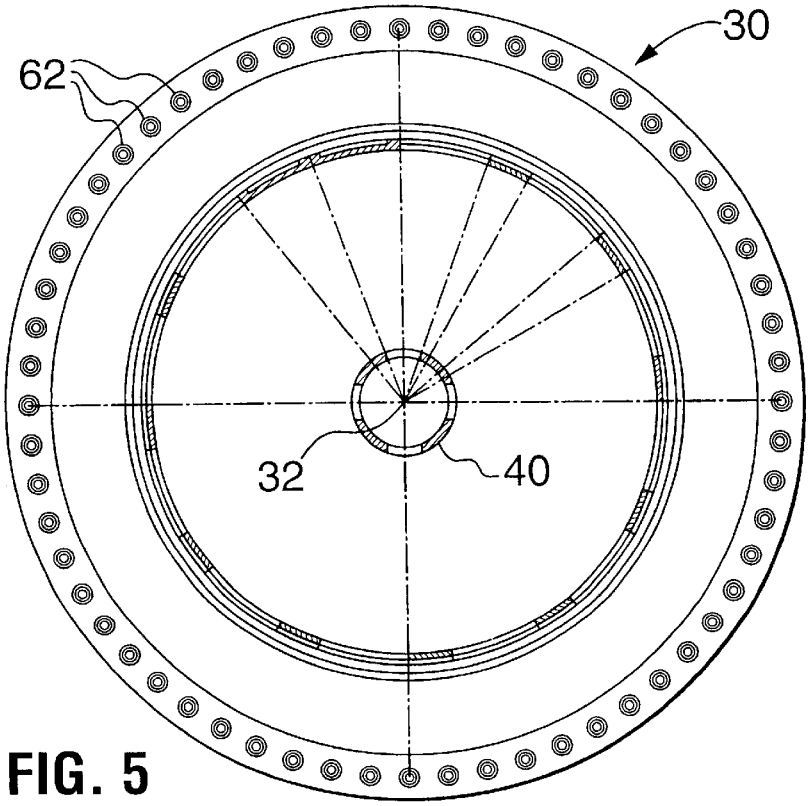
FIG. 5 is a sectional view taken on the line V—V in FIG. 3, shown somewhat schematically and to a smaller scale.

The central ring 44 defines a series (60 in all) of equiangularly spaced sets of assembly tooling 62 distributed around the periphery of the drum 30 as indicated in FIG. 5. Each tooling set 62 as shown in FIG. 4 comprises coaxially arranged within a respective bore 64 in the central ring 44, at the right hand end a tobacco stick guide bushing 66, at the left hand end a filter cover straightener bushing 68, and clamped between these a disc-shaped die 70. The guide bushing 66 has a length of approximately 30 mm and has a longitudinal central bore 72 of a diameter corresponding to the 8 mm diameter of the tobacco rod 14. The right hand or entry end of the bore 72 has a flared introducer section 73 of approximately 5 mm at a cone angle of 30°.

The filter cover straightener bushing 68 has a bore 74 that is sized to receive the filter cover 10 with clearance, having for example a nominal diameter of 8.39 mm with a flared entry taper 76 having a cone angle of and a length of approximately 5 mm.

At the right hand end as shown, the bore 74 has a band 78 which flares outwardly at a cone angle of approximately 6° over a length of 1.5 mm.

At this same right hand end of the bushing 68 there is an outer annular shoulder 80 which defines with the bore 64 and the die 70 an annular chamber which communicates with the band 78 through a series of angularly spaced radial ports 82.

The disc-shaped die 70 has a bore 84 which tapers from right to left as seen in FIG. 4, at the right hand end having a diameter that is substantially greater than the diameter of the bore 72, and at its left hand end terminating in a short cylindrical section 86 that is of a diameter slightly less than the diameter of bore 74.

Figure 3:
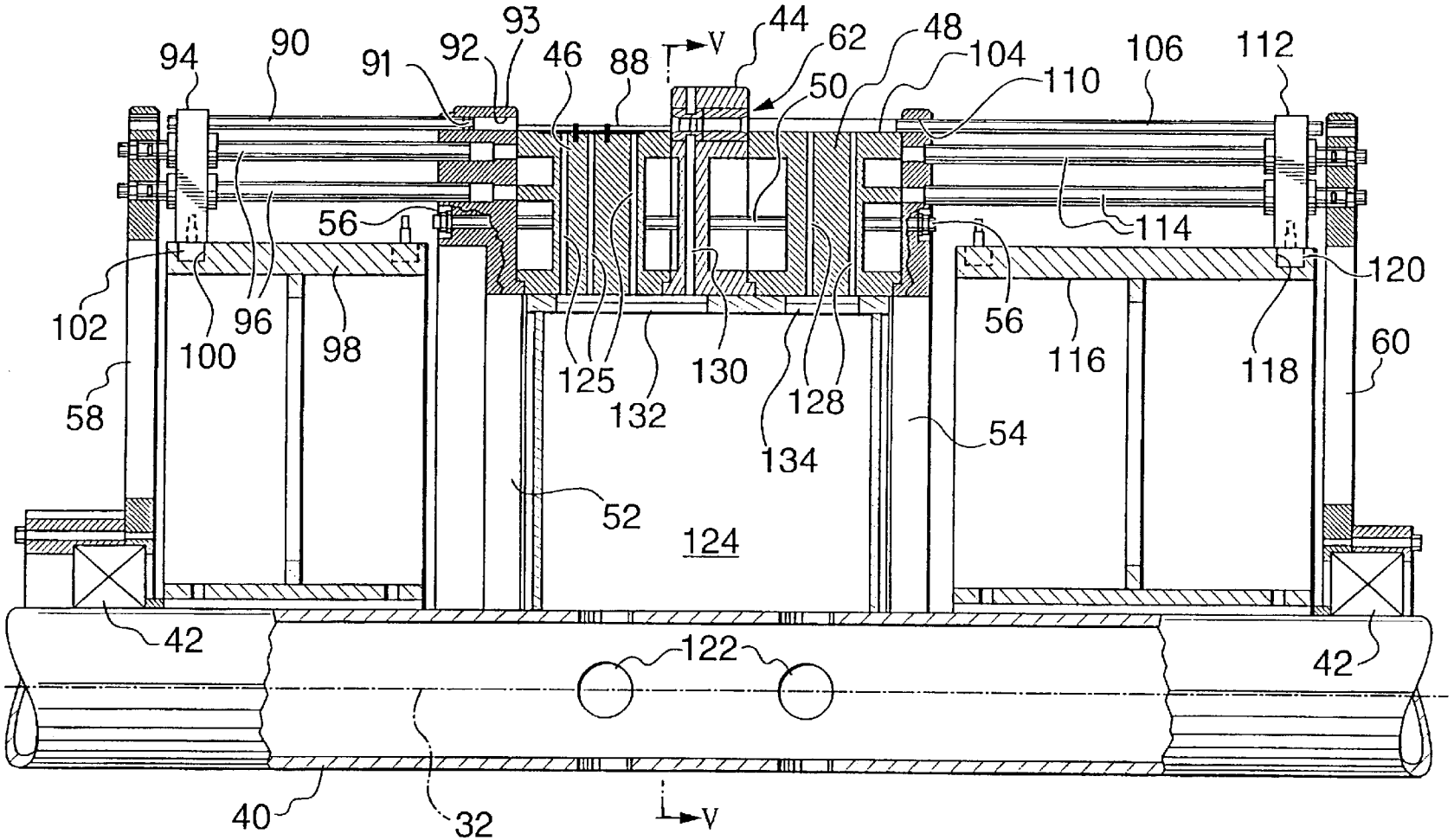
FIG. 3 is a fragmentary enlarged sectional view of the assembly apparatus taken generally on the line III—III in FIG. 2.

Associated with each of the assembly tooling sets 62 in the central ring 34 are corresponding guides and actuators arrayed on opposite sides thereof. Specifically and as seen in FIG. 3, in the outer periphery of the filter cover feed ring 46 is an axially extending rounded groove 88. Aligned with each guide groove 88 is a reciprocable cover pusher rod 90 guided in a locator bushing 93 carried in bore 92 in the clamping ring 52. At its outboard end the pusher rod 90 is secured in a carriage plate 94 which is guided for movement in a direction parallel to the axis of the pusher rod on a pair of guide rods 96 the opposite ends of which are secured in the clamping ring 52 and in the mounting ring 58 respectively. Axial movement of the pusher rod 90 is controlled by a cam drum 98 which is fixed with respect to the central shaft 40 and which defines around its periphery a cam groove 100 that is engaged by a follower roller 102 carried by the carriage plate 94.

In like manner the tobacco stick feed ring 48 has aligned with each of the assembly tooling sets 62 a guide groove 104 to receive tobacco sticks supplied from the feeding station 36. A tobacco stick pusher rod 106 at each feed station is guided in a bore 110 in the clamping ring 54 and is connected to a carriage plate 112 that is guided for movement axially of the rod 106 on cylindrical guide rods 114 as influenced by the interaction of a guide roller 120 in a cam groove 118 formed around the periphery of a cam drum 116 which is fixed to the central shaft 40.

From the foregoing it will be understood that upon rotation of the drum assembly relative to the shaft, each of the pusher rods 90 and 106 will be moved in sequence by the cam grooves 100, 118 to perform desired ranges of axial movements.

Since the grooves 88 and 104 are open in the radially outwards direction, it will be understood that means should be provided to ensure that the filter covers 10 and the tobacco sticks 12 are reliably retained in their respective grooves until the finished product is removed at the discharge station 38. For this purpose, the hollow shaft 40 is connected to a source of vacuum which communicates through ports 122 with an annular vacuum chamber 124 (FIG. 3) which surrounds the hollow shaft 40 and which has its outer periphery in sliding engagement with the inner periphery of the rings 44, 46, and 48 as seen in FIG. 3. Vacuum from the chamber 124 is communicated through the rings 46 and 48 by a series of radial passages 125 and 128 respectively which lead to the bottom each of the grooves 88 and 104 and which accordingly can apply a light suction force to the components present in these grooves.

Similarly a series of radial passages 130 lead from the chamber 124 each to one of the annular chambers defined by the shoulder 80 in each tooling set 62. Peripheral openings 132, 134 in the cylindrical wall defining the vacuum chamber 124 communicate vacuum through the passages 126, 128 and 130 at appropriate locations in the circumferential path followed by each of the assembly stations. As will be evident from FIG. 3, the assembly formed by the aligned rings 44, 46, 48 closely surrounds and moves in sealing contact with respect to the periphery of the vacuum drum 124.

Operation of the above described apparatus in assembling the product shown in FIG. 1C will now be described with reference to FIGS. 6A through 6E which illustrate the movements of the various components of the assembly tools as these rotate with the drum 30 around the axis 32. For ease of illustration, the filter cover feeding ring 46 and the tobacco stick feed ring 48 and the associated grooves 88 and 104 are omitted from FIG. 6A to 6E, as are the components of the drive arrangements for the pusher rods 90 and 106.

Figure 6A:
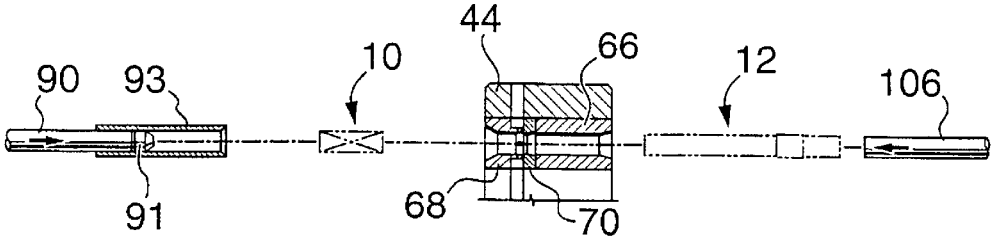
FIGS. 6A through 6E are schematic views showing a portion of the assembly cylinder of FIG. 3 to a larger scale and illustrating the successive steps of the assembly process.
Figure 6B:
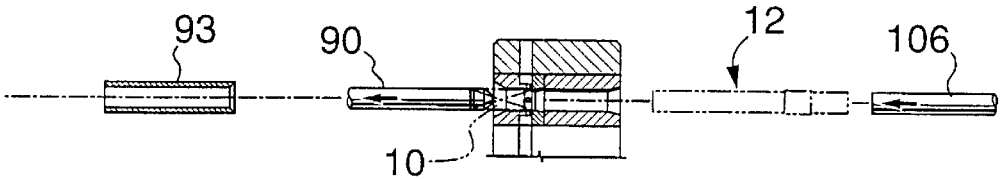

After the filter cover 10 and the tobacco stick 12 have been loaded into their associated grooves, the pusher rods 90 and 106 respectively are advanced to move these components towards the assembly tool within the central ring 44. As is evident from FIG. 6A the front end of the pusher rod 90 has a section 91 that is of slightly reduced diameter and is chamfered at its end, the diameter of the section 91 being slightly smaller than the internal diameter of the filter cover 10. Thus it will be understood that when the pusher rod 90 is advanced towards the filter cover 10 in the filter cover feed ring groove, the chamfered end of the pusher rod 90 will enter the filter cover 10 easily, as will the reduced diameter section 91, whereupon the filter cover 10 will be carried by the rod 90 as the latter moves to the right as seen in FIG. 6A to introduce the filter cover 10 into the bore of the bushing 68. This advancing movement.is continued until the leading end of the filter cover 10 abuts against the die disc 70, whereupon the movement is terminated at the position as shown in FIG. 6B. In this position vacuum applied through the passage 130 and ports 82 acts upon the end of the filter cover 10 and tends to flare it outwardly against the tapered bore 84 (FIG. 4) in the process smoothing out any nicks or other deformations which could impede access to the interior of the filter cover 10.

Figure 6C:
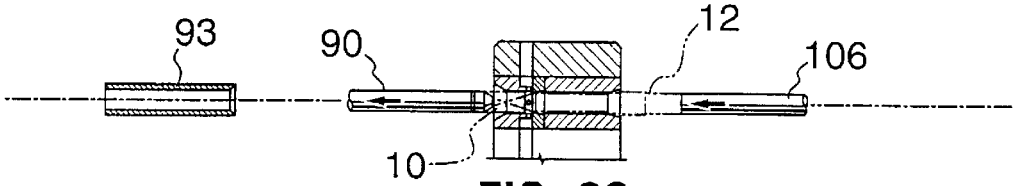

At this stage the pusher rod 106 is now advanced to engage the tobacco stick 12 and feed it into and through the bore of the guide bushing 66 and into the die disc 70. As the leading end of the tobacco stick 12 is advanced through the guide disc it is slightly compressed radially by the taper 84 to a diameter that is less than the internal diameter of the filter cover 10 located in the bushing 68 so that this leading end can be smoothly introduced into the filter cover 10 as the rod 106 continues to advance the tobacco stick 12 to the left as seen in FIG. 6C. During this compressive reduction by the die disc 70 the stick 12 is supported over a substantial part of its length in the bore 72 and therefore resists any tendency to buckle or deform.

Figure 6D:
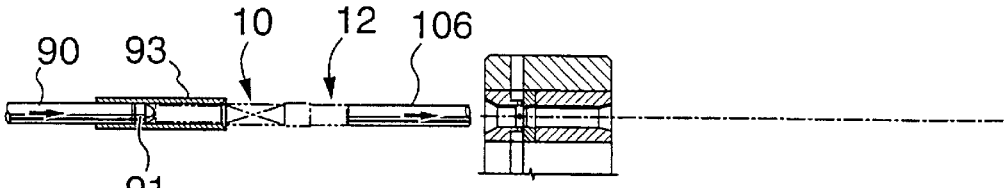
Figure 6E:
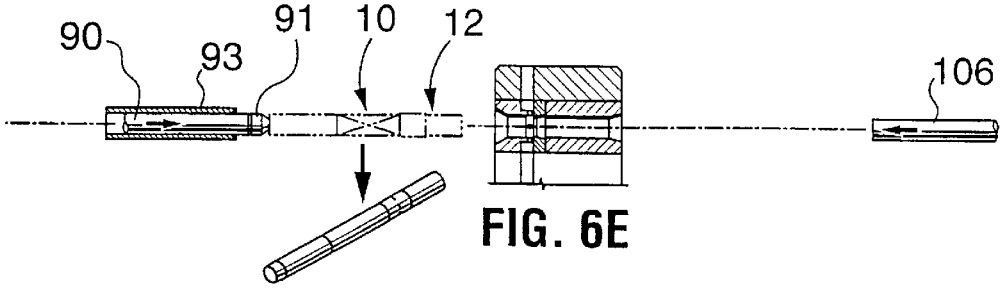

Once the tobacco stick 12 has been introduced into the filter cover 10, the pusher rods 90 and 106 with the partially assembled filter cover 10 and tobacco stick 12 located between them are moved in unison to the left to the position shown in FIG. 6D until the filter cover 10 abuts against the end of the stationary filter cover locator 93 (which has an internal diameter that is less than the diameter of the filter cover 10 but which is large enough to receive the end of the tobacco stick 12). With the filter cover 10 of the partially assembled product abutting the filter cover locator 93, continued movement of the rods 90 and 106 to the left as seen in FIG. 6 will have the effect of moving the tobacco stick 12 completely through the filter cover 10 to position the latter at a desired location in the length of the tobacco stick as seen in FIG. 6D. At this stage the entire product has been moved away from the central ring 44 so that when the rod 106 is withdrawn as shown in FIG. 6E and the rod 90 advanced, the now assembled product is moved out of the filter cover locator 93 and rests in the associated groove 88 of the filter cover feed ring 46 to be removed therefrom at the discharge station 38.

As is well understood in the art, movement of the rods 90 and 96 under control of the associated cam drums 98 and 116 can be varied widely to achieve the desired timing and range of movements. Referring to FIG. 2, if the 12 o'clock position is taken as 0°, feeding of the filter covers 10 at the station 34 will take place over the range 0 to 15° of drum movement. From 15° to 105° the cover pusher rod 90 moves the filter cover 55 millimeters into the bushing 88 and against the die disc 70, and from 105° to 137° the filter cover in the bushing 68 remains stationary to allow the vacuum effect to straighten it out if necessary and to allow partial insertion therein of the tobacco stick 12.

At the same time, on the stick feed ring 48 the tobacco sticks 12 are taken from the feed station 36 at between 60° and 90°, and from 95° to 137° the pusher rod 106 advances the tobacco stick 12 62 mm into the guide bushing 66.

At 137° to 215 the tobacco stick 12 is advanced another 129 mm and the rod 90 is retracted 139 mm. The rods 90 and 106 during this motion are moved at the same time to achieve perfect alignment for the movement of the partially assembled filter cover 10 and tobacco stick 12 out of the assembly tooling 62 in the central ring and move these to the position shown in FIG. 30 6D.

From 215° to 360° the stick pusher 106 is retracted to its rest position shown in FIG. 6A. From 215° to 315° the cover pusher rod 90 moves the finished product 41 mm to the position shown in FIG. 6E, and from 315° to 340° the pusher rod 90 is retracted to its original position.

To facilitate manufacture of the finished product, particularly at high speeds, it may be desirable to create the bevel 20 shown in FIG. 1A in a pre-processing step. This can be done for example by engaging the leading end of the tobacco stick in a sizing cone 21 as represented in FIG. 1A in a processing drum (not shown) arranged ahead of the feed station 36. While this step is not in any sense considered critical, it would certainly facilitate high speed manufacturing operations. As shown in FIG. 5, the drum 30 has a total of 60 assembling tooling sets 62 uniformly distributed about its periphery so that when rotated at a speed of about 67 rpm it will produce product at a rate of about 4000 per minute. At this speed, and more so at higher speeds, the pre-forming step to produce the taper 20 may be advantageous.

While a specific embodiment of the invention is disclosed in the foregoing in relation to the accompanying drawings, it will be understood that the invention is susceptible of many modifications and variations in the details thereof, and all such are intended to be included within the scope of the appended claims.

What is claimed is:

1. An apparatus for assembling a preformed tubular band of filter cover material onto a preformed tobacco-bearing component which comprises a filter fixed end-to-end with a tobacco rod, said apparatus comprising:

a first guide to receive said tubular band;

a second guide to receive said tobacco rod;

an assembly cylinder positioned between and in axial alignment with said first and second guides, said assembly cylinder having at a first end thereof adjacent said first guide an entry bushing which has a bore of a length and diameter corresponding to that of the filter cover, and at a second end an introducer bushing that has a bore substantially corresponding to the outer diameter of said tobacco rod, and between said entry bushing and said introducer bushing a sizing disc having a bore that tapers in the direction towards said entry bushing adjacent which it has a diameter that is smaller than the diameter of said entry bushing bore;

said apparatus including a first movable member that is engageable with said tubular band to advance it along said first guide towards and into the assembly cylinder, and a second member that is engageable with said tobacco bearing component to advance the latter along said second guide towards and into said assembly cylinder.

2. Apparatus according to claim 1 including cam means to effect timed sequential axial movements of said first and said second movable members to effect insertion of said tobacco rod into said tubular band to provide an assembly, and to remove said assembly from said assembly cylinder.

3. Apparatus as claimed in claim 2 comprising a series of assembly cylinders and associated first and second guides distributed around the periphery of a rotatable drum said cam means effecting required sequential movements of said first and second movable members in response to rotation of said drum.

4. Apparatus as claimed in claim 2 wherein each assembly cylinder includes tooling providing at one end a first bushing having a cylindrical bore sized to receive said tubular band and at an opposite end a guide bushing sized to receive said tobacco rod to support the latter over at least ⅓ of the length thereof, and between said first and guide bushings a die section having a bore adjacent said guide bushing that tapers from a diameter corresponding to that of the bore of said guide bushing to a smaller diameter that is less than the diameter of the bore of said first bushing to effect a slight radial compression of said tobacco rod when passed therethrough.

5. Apparatus as claimed in claim 4 including means for applying an expanding action to a portion of a tubular band within said first bushing and adjacent said tapered part.

6. Apparatus as claimed in claim 5 wherein said means for applying an expanding action comprise passage means opening to the bore of said first bushing and communicating with a source of vacuum.

7. Apparatus as claimed in claim 3 wherein said drum comprises a central ring having said series of assembly cylinders equiangularly distributed about its periphery, said central ring being clamped between a tubular band feeding ring and a tobacco bearing component feeding ring, said first and second guides being formed in said tubular band feeding ring and said tobacco bearing component feeding ring respectively, and each being equal in number to said assembly cylinders.

8. Apparatus as claimed in claim 7 wherein said rings have radial passages therein extending from said grooves and said tooling set to an interior periphery of each ring, said interior peripheries of said rings being in sliding engagement with a peripheral wall of a vacuum chamber, said peripheral wall having openings through which vacuum can be communicated to said passages.

9. Apparatus as claimed in claim 4 wherein said drum comprises a central ring having a series of assembly cylinders equiangularly distributed about its periphery, said central ring being clamped between a tubular band feeding ring and a tobacco bearing component feeding ring, said first and second guides being formed in said tubular band feeding ring and said tobacco bearing component feeding ring respectively, and each being equal in number to said assembly cylinders.

10. A method for assembling a preformed tubular band of filter cover material onto a preformed tobacco bearing component forming a smoking product which comprises a filter fixed end-to-end with a tobacco rod, the latter being enclosed in a tube of cigarette paper, the peripheral surface of the filter being porous thus rendering the product unsmokable, said tubular band being sized to provide a close sliding fit with the exterior of said tobacco rod, said method comprising:

arranging said tubular band and said tobacco-bearing component in axial alignment, and effecting relative axial movement towards one another of said tubular band and said tobacco-bearing component to bring these into engagement while effecting a slight compression of said tobacco rod to ease entry thereof into the interior of the tubular band to a desired location in the length of said tobacco rod;

wherein said tobacco rod is inserted into said tubular band by being passed through a sizing disc positioned adjacent said tubular band and that has a bore which tapers towards said tubular band, said sizing disc adjacent said tubular band having a diameter that is slightly less than said tubular band, passage of said tobacco rod through said sizing disc effecting a slight localised compression of said tobacco rod thus easing its entry into said tubular band.

11. A method for assembling a preformed tubular band of filter cover material onto a preformed tobacco bearing component which comprises a filter fixed end-to-end with a tobacco rod, the latter being enclosed in a tube of cigarette paper, the peripheral surface of the filter being porous thus rendering the product unsmokable, said tubular band being sized to provide a close sliding fit with the exterior of said tobacco rod, said method comprising:

arranging said tubular band and said tobacco-bearing component in axial alignment, and effecting relative axial movement towards one another of said tubular band and said tobacco-bearing component to bring these into engagement while effecting a slight compression of said tobacco rod to ease entry thereof into the interior of the tubular band to a desired location in the length of said tobacco rod;

wherein relative axial movement of said tubular band and said tobacco rod is effected by an arrangement of cam-operated rods.

12. A method for assembling a preformed tubular band of filter cover material onto a preformed tobacco bearing component which comprises a filter fixed end-to-end with a tobacco rod, the latter being enclosed in a tube of cigarette paper, the peripheral surface of the filter being porous thus rendering the product unsmokable, said tubular band being sized to provide a close sliding fit with the exterior of said tobacco rod, said method comprising:

arranging said tubular band and said tobacco-bearing component in axial alignment, and effecting relative axial movement towards one another of said tubular band and said tobacco-bearing component to bring these into engagement while effecting a slight compression of said tobacco rod to ease entry thereof into the interior of the tubular band to a desired location in the length of said tobacco rod;

wherein during assembly the end of said tubular band that is initially closest to the tobacco rod is subjected to an expanding action to maximize the interior diameter of the band at that end.

13. A method as claimed in claim 12 in said expanding action is applied by exposing the exterior of said end to a source of vacuum.

14. A method as claimed in claim 13 wherein relative axial movement of said tubular band and said tobacco rod is effected by an arrangement of cam-operated rods.

* * * * *